US005191383A

United States Patent [19]

Watanabe

[11] Patent Number: 5,191,383

[45] Date of Patent: Mar. 2, 1993

[54] IMAGE FORMING APPARATUS WITH CONVEYING PATH ACCESS

[75] Inventor: Junji Watanabe, Yokohama, Japan

[73] Assignee: Kabushiki Kaisha Toshiba, Kawasaki, Japan

[21] Appl. No.: 780,058

[22] Filed: Oct. 21, 1991

[30] Foreign Application Priority Data

Oct. 31, 1990 [JP] Japan ..... 2-293882

[51] Int. Cl.[5] ..... G03G 21/00

[52] U.S. Cl. ..... 355/321; 355/308

[58] Field of Search ..... 355/200, 308, 309, 316, 355/318, 319, 321; 271/273

[56] References Cited

U.S. PATENT DOCUMENTS

| | | | |
|---|---|---|---|
| 4,412,734 | 11/1983 | Shibuya et al. | 355/309 |
| 4,534,643 | 8/1985 | Watanabe | 355/319 |
| 4,857,963 | 8/1989 | Sutou | 355/321 |
| 4,903,076 | 2/1990 | Sakakibara | 355/200 |
| 4,922,306 | 5/1990 | Araki et al. | 355/313 |

*Primary Examiner*—A. T. Grimley
*Assistant Examiner*—William J. Royer
*Attorney, Agent, or Firm*—Foley & Lardner

[57] ABSTRACT

An image forming apparatus includes a first conveying path on which paper enters between a photosenitive drum and a transfer unit facing the drum and leaves there. A lower unit in an opening/closing unit holds, on the lower side of the first conveying path, a lower resist roller in a resist roller pair, belt conveyor, lower paper discharge roller in a paper discharge roller pair and transfer unit. The lower unit is movable in a direction away from the photosensitive drum so as to open the first paper conveying path. An apparatus body includes a paper storage section having a double function of providing a spacing for allowing the opening/closing motion of the lower unit and storing image-printed paper therein. The apparatus body has a second conveying path connected to the first conveying path and guiding the image-formed paper to the paper storage section so as to allow the image-formed paper to be stored in the paper storage section in a reversed state.

19 Claims, 7 Drawing Sheets

IMAGE FORMING APPARATUS WITH CONVEYING PATH ACCESS

BACKGROUND OF THE INVENTION

1. Field of the Invention

The present invention relates to an image forming apparatus, such as an electronic copying machine or a laser printer and, in particular, an image forming apparatus improving the discharging of recording paper (hereinafter referred to as copying paper or simply paper) and the removing of paper jamming.

2. Description of the Related Art

U.S. Pat. No. 4,412,734 discloses an electronic copying apparatus of a clamshell type in which an apparatus body incorporating an image forming means therein is divided into upper and lower units with a paper conveying path as a boundary and the upper unit is accessed from above.

In the conventional electronic copying apparatus, upon the occurrence of jamming, the upper unit is opened from above so that jamming state can be removed.

In the case where paper image-formed by an image forming process means is to be discharged in the conventional electronic copying apparatus, etc., it is done onto a paper discharge tray ordinarily provided at a location outside the apparatus body, in particular, to the left of the apparatus body.

In the conventional apparatus as set out above, the whole upper unit of the clamshell structure provides an opening/closing unit through which access is gained to a paper jam site.

Since the whole upper unit is heavy in weight, it is cumbersome or unweildy to open or close at the time of removing paper jamming.

In order to precisely fit the heavy upper unit (opening/closing unit) into the rest of the apparatus, a complex, strong and bulky support mechanism has to be provided for openably supporting the heavy upper unit and a resultant apparatus becomes expensive as a whole.

Further, when the upper unit is opened and closed at the time of removing paper jamming during a portion of a copying operation, documents may fall out of a document rest and platen cover onto the floor and be scattered around, not only soiling the documents, etc., but also having to collect them.

Further, since the paper discharge tray as set out above is provided at the upper area of the location outside the apparatus body, it is necessary to secure an extra spacing for that projecting paper discharge tray.

U.S. Pat. No. 4,922,306, in particular, discloses a structure in which image-formed paper is conveyed temporality to an intermediate tray situated below a body. The intermediate tray is used to re-supply the paper to a given location, not used for discharge. This document discloses nothing about a detailed jamming handling mechanism and provides no solution to the aforementioned problem.

SUMMARY OF THE INVENTION

It is accordingly the object of the present invention to provide an image forming apparatus which can make an opening/closing unit opened and closed at the time of paper jamming light in weight and compact in size, prevent a fall, on the floor, of documents, etc., placed at a location outside an apparatus body at the opening/closing of the opening/closing unit, and obviate the need of providing a paper discharge tray externally jutted from an apparatus body and achieve less installation site.

According to the present invention, there is provided an image forming apparatus comprising:

an image forming apparatus, comprising:

means for forming an image on a recording paper in a image forming position;

means for conveying the recording paper through the image forming position, the conveying means having a conveying path through which the recording paper is conveyed;

means, provided near the conveying means, for defining a predetermined spacing;

a unit for holding the conveying means as one body;

means for movably supporting the unit between a set position where the unit allows the conveying means to convey the recording paper and an opening position where the unit is moved in the spacing to open the conveying path; and means, provided on the spacing, for storing the recording paper conveyed by the conveying means.

According to the image forming apparatus of the present invention, the opening/closing unit for access to the paper conveying path at a time of removing paper jamming holds part of the first conveying means and transferring means, thus making the opening/closing unit swingable at the time of removing water jamming light in weight and compact in size. Further, the opening/closing unit can be readily opened or closed with less force and hence readily operated and no bulkier supporting means is required for supporting the opening/closing unit, thus obtaining a low-cost apparatus as a whole.

Since the paper holding means for holding the image-formed paper therein is provided in the apparatus body, the documents, etc., placed outside the apparatus body at the opening and closing of the opening/closing unit never fall, for example, on the floor.

Further, the image forming apparatus can be provided which can eliminate the necessity of providing any paper discharge tray externally jutted from the apparatus body and thus achieve less spacing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

One embodiment of the present invention will be described below with reference to FIGS. 1 to 8.

Figure 1:
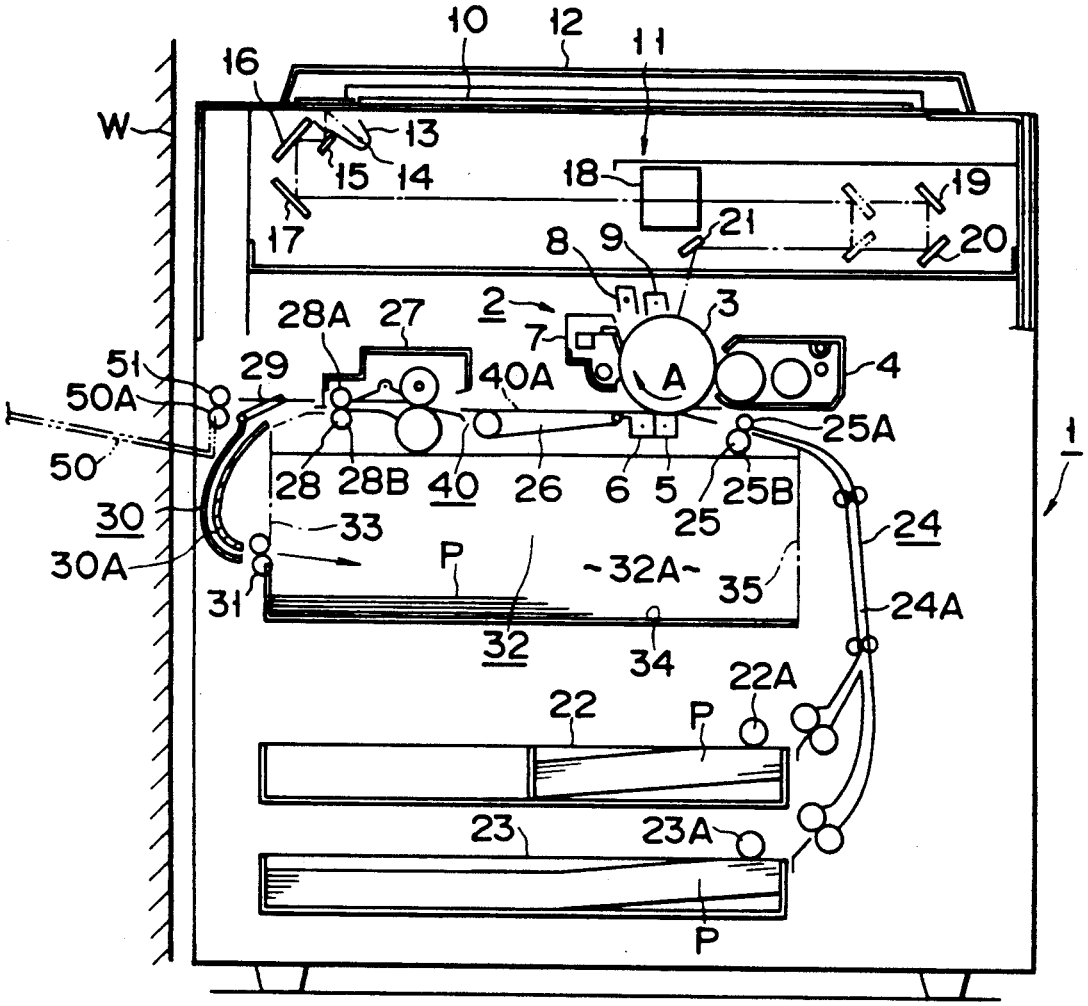
FIG. 1 is a view diagrammatically showing the inner arrangement of an image forming apparatus according to a firs embodiment of the present invention.
Figure 2:
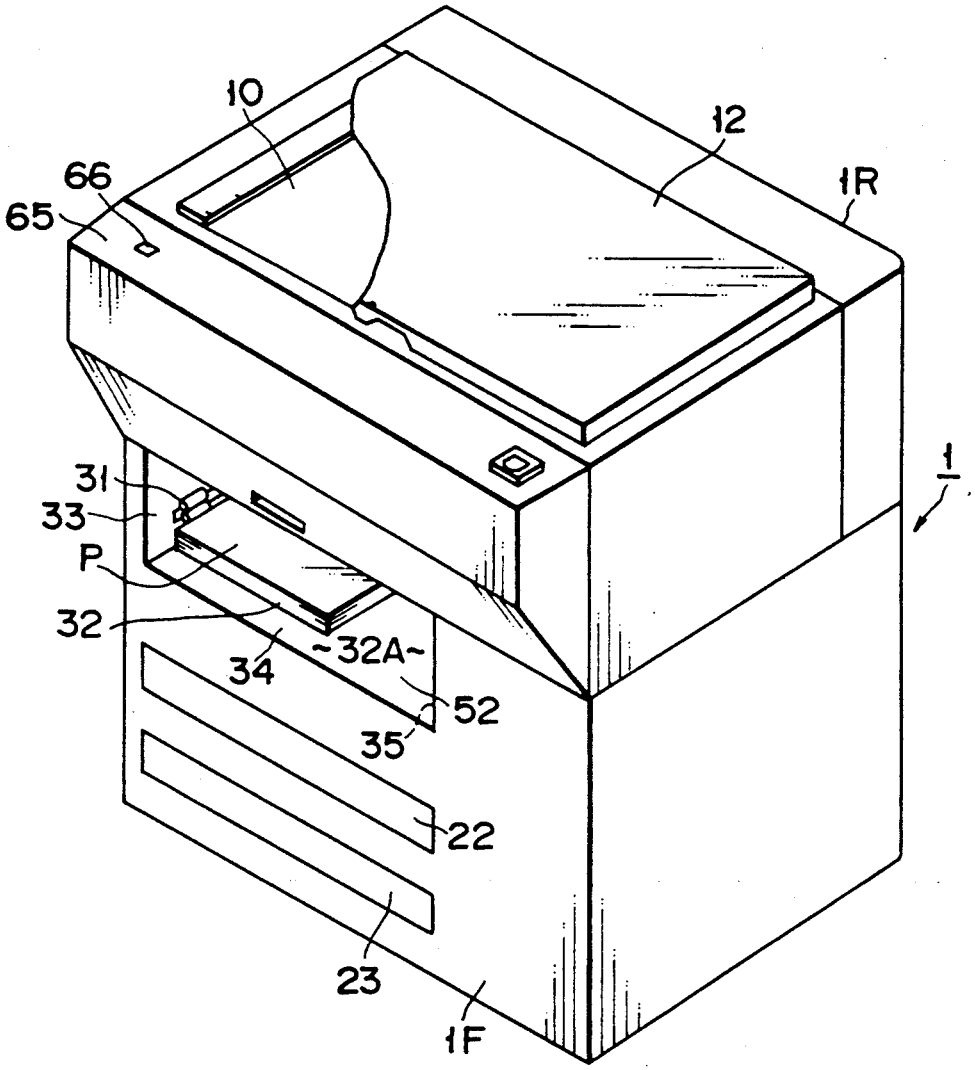
FIG. 2 is a perspective view diagrammatically showing the image forming apparatus of FIG. 1 with part of a platen cover cut away.

FIG. 1 schematically shows a general arrangement of an electronic copying machine as an image forming apparatus according to the present invention. FIG. 2 schematically shows an outer appearance of a portion of a platen cover as shown in a cutout state.

In the Figure, reference numeral 1 shows an apparatus body including an image forming process means 2 as shown in FIG. 1.

The image forming process means 2 includes a photosensitive drum 3 as an image carrier which is rotatably mounted at a substantially central area in the apparatus body 1. Various units or devices are provided around the photosensitive drum 3 along a rotation direction as indicated by an arrow A.

That is, a developing unit 4 for developing an electrostatic image which is formed on the photosensitive drum 3 into a visual image by a developing agent, a transfer unit 5 for transferring the visual image which is formed on the photosensitive drum 3 to recording paper P, a paper separation unit 6 for separating the visual image-transferred paper P away from the photosensitive drum 3, a cleaning unit 7 for cleaning the developing agent left deposited on the photosensitive drum after the visual image has been transferred, a discharger 8 for removing a residual image on the photosensitive drum 3 and a charger 9 for uniformly charging the photosensitive drum 3 are arranged in that order starting from the right side of the photosensitive drum 3 as viewed from FIG. 1.

Further, an exposure device 11 is provided which imparts "slit" exposure light to the photosensitive drum 3 from a location between the charger 9 and the developing unit 4 while scanning an original document, not shown, on platen glass 10 provided at the upper side of the apparatus body 1.

A platen cover 12 is covered on the platen glass 10 to press the document, not shown. The platen cover 12 is rotatably mounted by a hinge mechanism, not shown, on the rear side and can be opened, if necessary, over the platen glass 10.

The exposure device 11 comprises an optical system composed of a reflector 13, an exposure lamp 14 surrounded at its back with the reflector 13, first, second and third reflection mirrors 15, 16 and 17, a lens 18, fourth, fifth and sixth reflection mirrors 19, 20 and 21, etc.

The reflector 13, exposure lamp 14 and first reflection mirror 15 are mounted on a first carriage, not shown, and can be moved a rightward direction in FIG. 1. The second and third reflection mirrors 16 and 17 are mounted on a second carriage, not shown, and can be moved at one half the moving speed of the first carriage to allow the document, not shown, on the platen glass 10 to be scanned from one end to the other end.

The fourth and fifth reflection mirrors 19 and 20 are mounted on a third carriage, not shown, and can be displaced to a position corresponding to a copying magnification.

Below the apparatus body 1 holding the image forming process means thus arranged, first and second paper supply cassettes 22 and 23 are arranged one over the other in a two-stage stack.

In a substantially central zone of the apparatus body 1 at a location between the first paper supply cassette (upper paper supply cassette) 22 and the image forming process means 2 as viewed in the up/down direction in FIG. 1, a spacing 40 is provided where a paper storage section 32 is provided as a paper storage means for storing image-formed paper P.

A paper conveying device 24 is provided as a paper conveying means for selectively taking copying paper (recording paper) out of the first or the second paper supply cassette 22 or 23 via a paper feed roller 22A or 23A, respectively, and conveying it to the image forming process means 2. The paper conveying device 24 comprises a plurality of conveying guide plate pairs and a plurality of conveying roller pairs.

A first conveying device 40 is provided as a first conveying means including a first paper conveying path 40A connected to the paper feed path 24A past a location between the transfer unit 5 and the photosensitive drum 3. The first conveying device 40 conveys copying paper P to an image transfer section between the transfer device 5 and the photosensitive drum 3 and the image-transferred paper P to a downstream side.

In the apparatus body 1, a second conveying device 30 is provided as a second conveying means including a second paper conveying path (paper discharge path) 30A connected to the downstream side of the first paper conveying path 40A. The second conveying device 30 conveys the paper P which is moved past the first paper conveying path 40A to the paper storage section 32 where the paper is stored in a reversed state.

A resist roller pair 25 comprising an upper resist roller 25A and lower resist roller 25B is arranged upstream of the image transfer section of the first paper conveying path 40A. A fixing unit 27 and a paper discharge roller pair 28 comprising an upper discharge roller 28A and lower discharge roller 28B are arranged downstream of the image transfer section of the first paper conveying path 40A. Further, a belt conveyor 26 is arranged at a location between the paper separation unit 6 and the fixing unit 27.

A gate 29 is provided, as a switching means, in the neighborhood of the connection section between the terminating side of the first paper conveying path 40A and the second paper conveying path 30A. A second paper discharge pair 31 is arranged in the terminating side of the second paper conveying path 30A.

In the neighborhood of a gate 29, a third paper discharge roller pair 51 is arranged for discharging the paper P onto a paper discharge tray 50 provided, as required, on the paper discharge section 50A outside the apparatus body 1.

An access opening 52 is provided at the front side of the apparatus body 1 to allow an external exposure of the paper storage section 32 in the spacing 32A.

In the formation of an image, the photosensitive drum 3 is rotated in a direction of an arrow A and uniformly charged by the charger 9. By moving the first carriage with the exposure lamp 14 and first reflection mirror 15 mounted thereon and second carriage with the second and third reflection mirrors 15 and 16 mounted thereon in the exposure device 11, the document, not shown, on the platen glass 10 is scanned and the reflection light is directed past the lens 18 and past the fourth, fifth and sixth reflection mirrors 19, 20 and 21 to the photosensitive drum 3 where a slit exposure is given to enable an electrostatic latent image which corresponds to an original image to be formed on the photosensitive drum 3.

The electrostatic latent image on the photosensitive drum 3 faces the developing unit 4 to provide a visual image with the use of a developing agent.

On the other hand, copying paper P is taken selectively out of the first paper supply cassette 22 or the second paper supply cassette 23 and conveyed to the first paper conveying path 40A past the paper feed roller 24A. After the paper abuts against the resist roller pair 25 in the stopped state and has its forward end properly oriented, it is fed into the image transfer section between the photosensitive drum 3 and the transfer unit in synchronism with the formation of the visual image (developing agent image) on the photosensitive drum 3 as the resist roller pair 25 is rotated.

With a corona discharge occurring on the back of the paper P, the transfer unit 5 allows the developing agent image on the photosensitive drum 3 to be electrostatically transferred to the paper P.

The developing agent image bearing paper is separated by the paper separating unit 6 from the photosensitive drum and conveyed to the fixing unit 27 through the belt conveyor 26.

After the developing agent image is transferred to the paper, any residual developing agent on the photosensitive drum 3 is removed by the cleaning means 7 and a potential on the photosensitive drum 3 is made at a predetermined level by the discharger 8 in readiness for the next copying operation.

The paper P with the developing agent fused and fixed thereon by the fixing unit 27 is discharged by the discharge roller pair 28 out of the fixing unit 27.

The resultant paper P is moved downstream of the first paper discharge roller pair 28 to the gate 29 whereby it is switched to, and guided into, the second paper conveying path (paper discharge path) 30A in the apparatus body.

The so guided paper P is fed past the second, paper discharge roller pair 31 onto the paper storage section 32 in the spacing 32A of the apparatus body 1 and stacked there. The spacing 32A is provided in the apparatus body 1 at an area defined by frames 33, 34, 35, etc.

Figure 3:
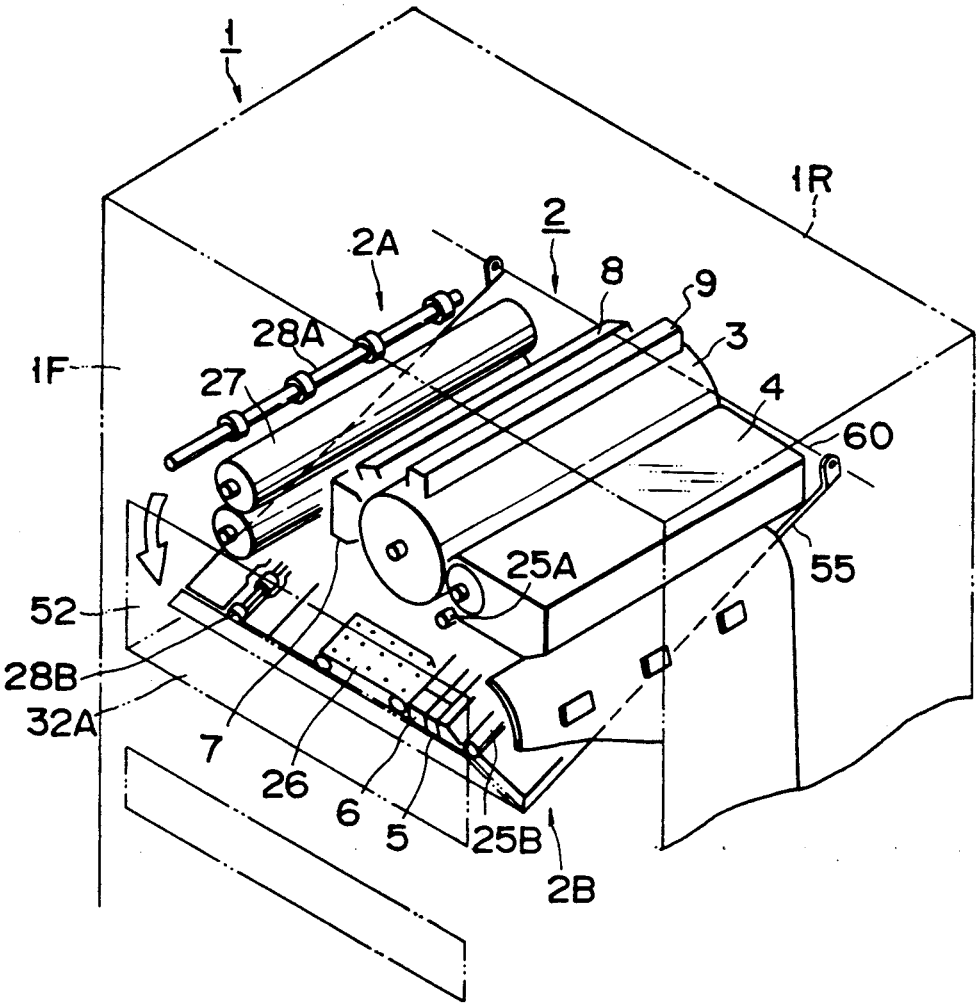
FIG. 3 is an explanatory view showing the arrangement of an image forming process means in the image forming apparatus with an opening/closing unit opened.

As shown in FIG. 3, photosensitive drum 3, developing unit 4, cleaning means 7, discharger 8, charger 9, upper resist roller 25A, fixing unit 27 and upper discharge roller 28A are collectively provided as an upper unit 2A. The lower resist roller 25B, transfer unit 5, separation unit 6, belt conveyor 26 and lower paper discharge roller 28B are collectively provided as a lower unit 2B. The upper unit 2A and lower unit 2B are defined with the first paper conveying path 40A as a boundary.

The lower unit 2B serves as an opening/closing unit which can open the first paper conveying path 40A at the time of paper jamming.

The lower unit 2B is so supported by a unit supporting means 56 that it is moved away from the photosensitive drum 3 to allow the opening of the first paper conveying path.

The unit body 55 serving as a holding means for the respective devices or units of the lower unit 2B is rotatably supported by a shaft (pivotal member) 60 provided on the rear side 1R of the apparatus body 1.

A plunger 61A of a hydraulic cylinder (actuating means) 61 is connected to the unit body 55 of the lower unit 2B. Upon pressing of a unit open/close switch 66 on an operation panel 65, the hydraulic cylinder 61 enables a hydraulic switching valve, not shown, to be switched so that the plunger 61A is extended and retracted. By so doing the lower unit 2B is supported in a horizontal set state as indicated by the solid lines in FIG. 4 and the forward end side of the lower unit corresponding to the front side 1F of the apparatus body 1 is so supported as to provide a tilted down end side in an open state as indicated by dots-dash lines in FIG. 4.

Figure 4:
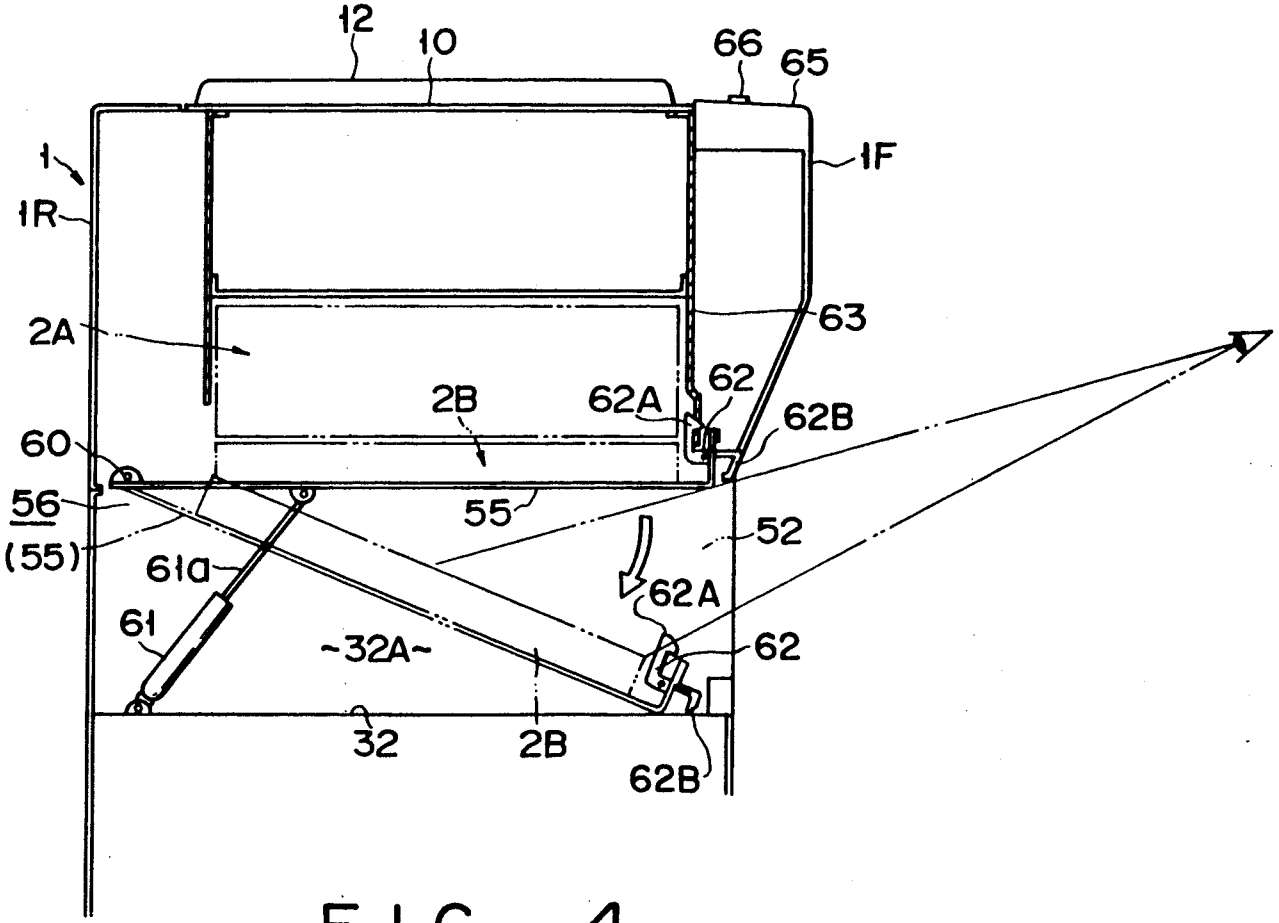
FIG. 4 is an explanatory view diagrammatically showing the arrangement of an opening/closing unit held in an opened state.

A locking mechanism 62, as shown in FIG. 4, having a hook 62A as well as a handle 62B, is provided on the free end side of the unit body 55, that is, on the forward end side of the unit body 55 corresponding to the front side of the apparatus body 1. The lower unit 2B can be positively fixed to a set position by anchoring the hook 62A in an engaging hole provided in a support frame 63 of the upper unit 2A. Handle 62B is provided at the unit 55 so that the unit 55 may be moved between a set position and an opening position, handle 62B being arranged in a position which allows it to be operated on the outside of the body 1.

Further, the paper storage section 32 in the spacing 32A is provided below the lower unit 2B in the opening/closing unit, allowing the lower unit 2B to be moved away from the upper unit.

The opening and closing operations of the lower unit 2B are done at the time of paper jamming to remove that paper P jammed or caught on the first paper conveying path 40A. When the front end side of the lower unit 2B is swung down, the lower unit 2B is tilted toward its front end side as shown in FIG. 4, offering a wider viewing field at the time of eliminating a jammed state.

The paper discharge tray 50 is usually removed from the present apparatus and, as shown in FIG. 1, the apparatus body 1 can be located as near to a wall surface W as possible, thus saving any larger installation site.

If there is any extra ground spacing, the paper discharge tray 50 can be so designed as to be mounted, if required, on the apparatus body 1 as indicated by the dots-dash lines in FIG. 1. In this case, upon the switching of a discharge paper mode changeover switch, the paper discharge route is so switched as to enable the "image-fixed" paper P to be discharged toward the third paper discharge roller pair 51 through the gate 29. In this way, the "image-fixed" paper P is discharged externally onto the paper discharge trays 50 where it is stacked in place.

The lower resist roller 25B, conveying belt 26, lower paper discharge roller 28B, etc. incorporated into the lower unit 2B are driven from a swing fulcrum side of the lower unit 2B.

The lower resist roller 25B will be explained below with reference to FIGS. 5 and 6.

Figure 5:
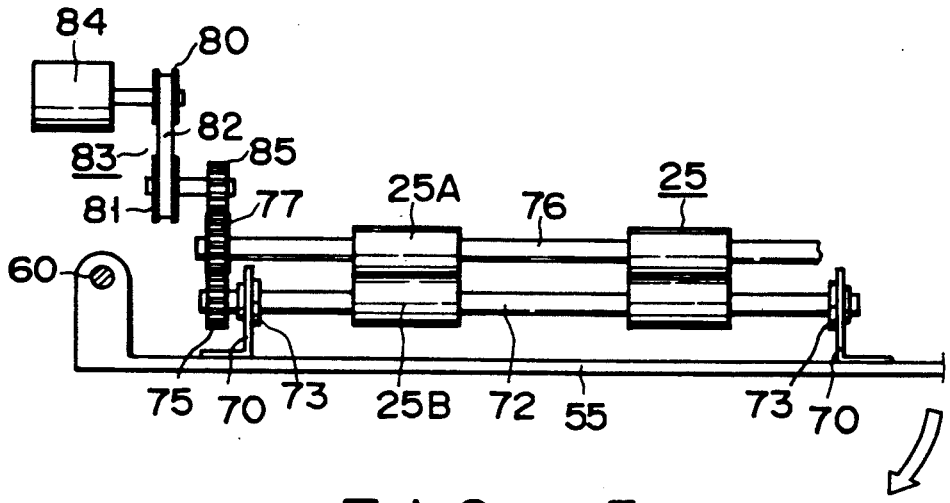
FIG. 5 is an explanatory view diagrammatically showing a paper discharge roller pair in the opening/-closing unit of the present image forming apparatus.

As shown in FIG. 5, a rear side frame 70 and front side frame 71 are fixed to the upper surface of the unit body 55 in a parallel fashion and brushes 73, 73 are held, by the frames 70, 71 as a bearing member for rotatably supporting a shaft 72 of the lower resist roller 25B. The lower resist roller 25B is so supported as to be rolled in contact with the upper resist roller 25A of the upper unit 2A in a parallel fashion.

A gear (drive force transmitting means) 75 is mounted on the rear end portion of the shaft 72 of the lower resist roller 25B and meshes with a gear 77 mounted on a shaft 76 of the upper resist roller 25A. The gear 77 engages with a gear 85 for receiving a drive force from a motor (a driving source) 84 through a drive force transmitting system 83 comprising pulleys 80, 81 and belt 82. The driving of the motor 84 results in the lower resist roller 25B and upper resist roller 25A being driven.

Figure 6:
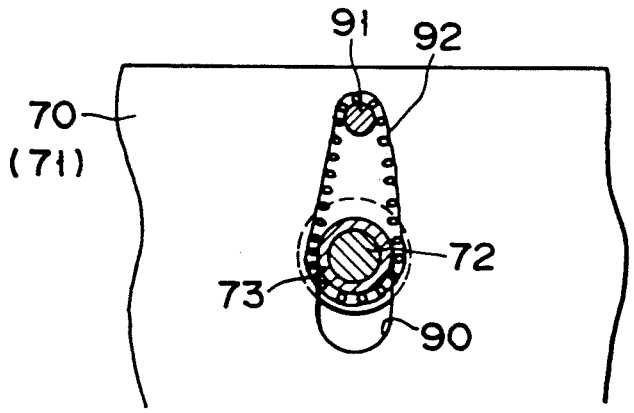
FIG. 6 is a view showing the supporting state of a discharge roller's bearing in the opening/closing unit of the image forming apparatus.

As shown in FIG. 6, the brushes 73, 73 rotatably supporting the lower resist roller 25B are fitted into the associated holes 90, 90 such that they are moved in an up/down direction, the elongated hole 90 being provided in the frame (70, 71) and having its longitudinal opposite ends extending in the up/down direction as shown in FIG. 6. The brush 73 is normally upwardly pulled by an endless spring 92 anchored to a shaft 91 extending from the frame 70(71).

There is risk that, when the opened lower unit 2B is swung back into a horizontal set position (the position a indicated by the solid lens in FIG. 4) with the swing fulcrum as a center, the lower resist roller 25B will positively engage with the gear 77 for the, upper resist roller 25A. In this case, however, the brush 73 is downwardly moved against an urging force of the tension spring 92 with the elongated hole 90 as a guide, neither preventing the closing operation of the lower unit 2B nor causing a damage to the gears 75 and 77.

Even when, upon the closure of the lower unit 2B, the gears 75 and 77 are improperly in mesh with each other, a proper intermeshing state can be positively achieved at a point of time when the gear 77 is rotated to some extent.

The belt conveyor 26 and lower paper discharge roller 28B have also basically the same support structure and drive force transmitting structure as the aforementioned lower resist roller 25B and any further explanation is, therefore, omitted so as to avoid duplication.

The transfer unit 5 and separation unit 6 incorporated into the lower unit 2B receive electric power from the rear side, that is, the swing fulcrum side of the lower unit 2B.

The transfer unit 5 will be explained below with reference to FIGS. 7 and 8.

Figure 7:
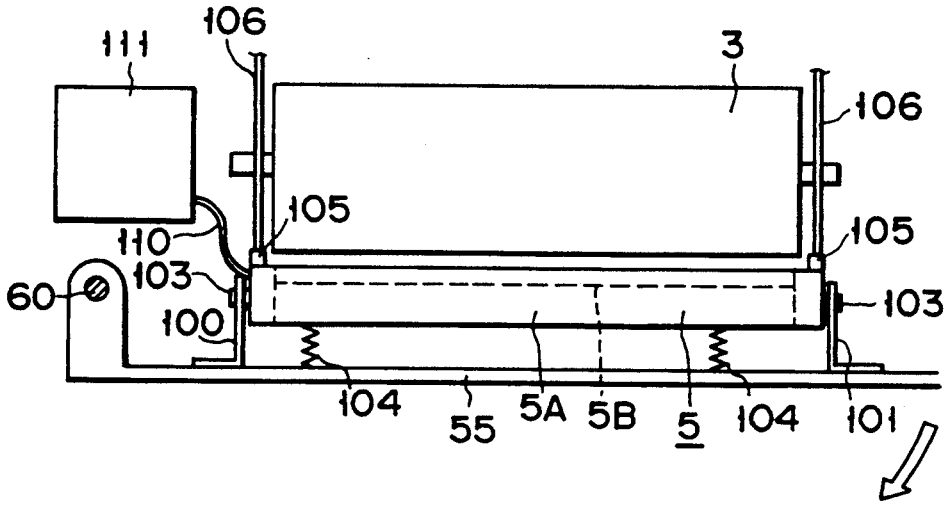
FIG. 7 is an explanatory view diagrammatically showing the state of a transfer unit in the opening/closing unit in the present image forming apparatus.
Figure 8:
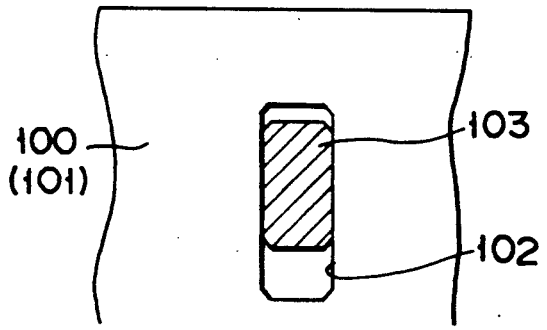
FIG. 8 is a view showing the supporting sate of the transfer unit in the opening/closing unit of the present image forming apparatus.

As shown in FIG. 7, a rear side frame 100 and front side frame 101 are fixed, in a parallel fashion, to the upper surface of the unit body 55. As shown in FIG. 8, support projections 103 and 103 extend through the opposite ends of the shield case 5A in the transfer unit 5 and engage with elongated holes 102, 102 provided in the frames 100 and 101 so that they are so supported as to be movable in an up/down direction. In this case, the elongated holes 102 and 102 ar longer in the up/down direction.

Compression springs 104, 104 are arranged at a location between the bottom surface to the sheet case 5A for the transfer unit 5 and the upper surface of the unit body 55, urging the transfer unit 5 normally upwardly.

Further, positioning projections 105 and 105 are provided on the upper faces of the opposite ends of the sheet case 5A of the transfer unit 5 and are brought into abutment with the lower ends of frames 106, 106 for supporting the shaft of the photosensitive drum 3 in the upper unit 2A.

When the lower unit 2B is placed in a horizontally set state as indicated by the solid lines in FIG. 4, a given distance is kept between a charge wire 5B of the transfer unit 5 and the photosensitive drum 3.

Electric power is supplied from a high pressure power supply 111 to the charge wire 5B of the transfer unit 5 via a flexible cable (power supply means) 110, offering no hindrance to opening and closing the lower unit 2B.

The separation unit 6 also has basically the same support structure and power supply structure as the aforementioned transfer unit 5 and any further explanation thereof is, therefore, omitted to avoid duplication.

Figure 9:
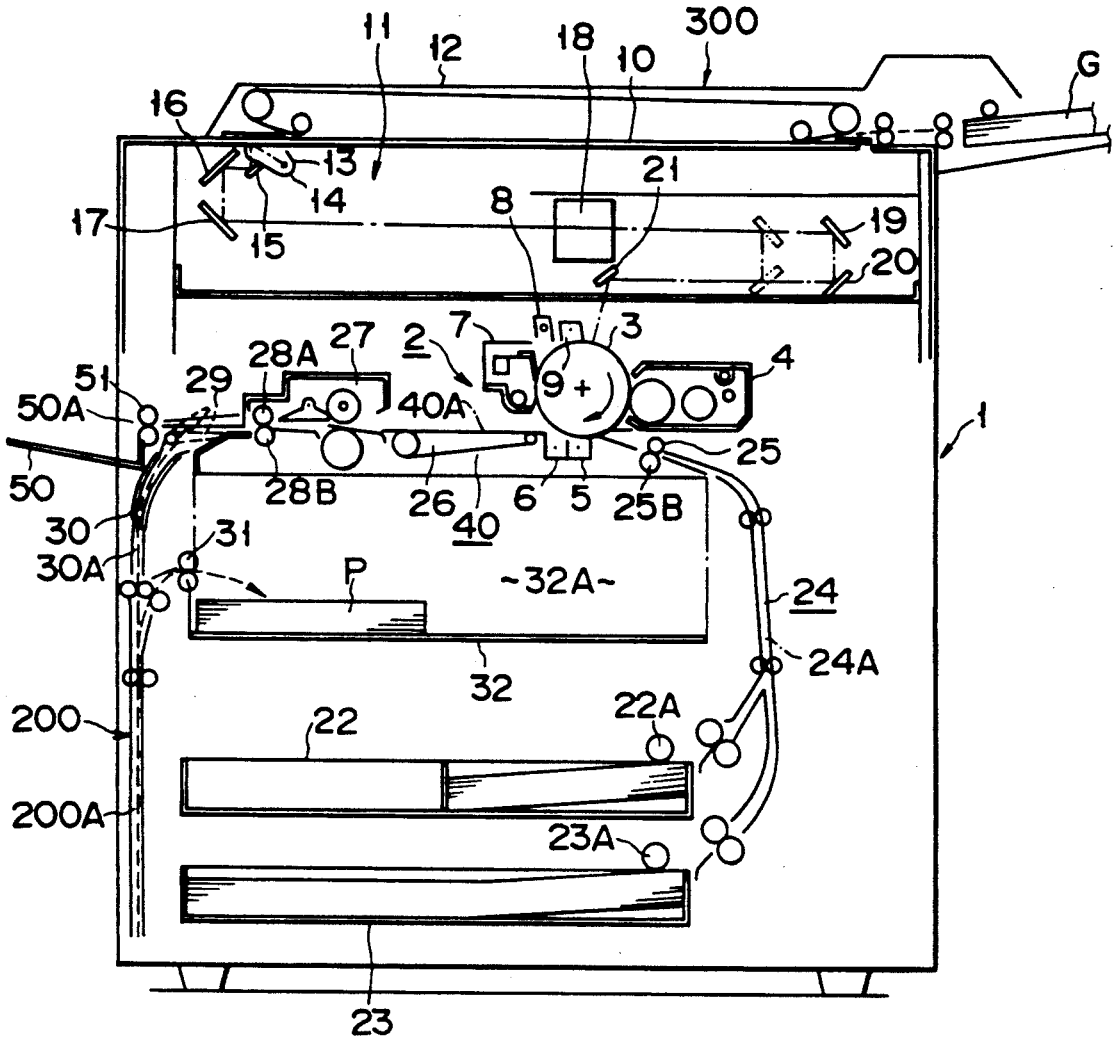
FIG. 9 is a view diagrammatically showing the inner arrangement of an image forming apparatus according to a second embodiment of the present invention.

FIG. 9 shows another embodiment of the present invention. In this comparison with the preceding embodiment, this embodiment includes a third conveying device 200 provided as a third conveying means. The third conveying device 200 includes a conveying direction switching path 200A for enabling paper P which is fed on a second paper conveying path (paper discharge path) 30A to be conveyed onto the paper storage section 32 after the rear end of the paper P is reversed with the forward end first emerging. The third conveying device 200 comprises a plurality of conveying guide plates and a plurality of conveying roller pairs.

The third conveying device 200 is of such a type that the paper P which is delivered by a switching means 29 from the first discharge roller pair 28 to a paper discharge path 30 is guided onto the conveying direction switching path 200A and, after being switched back for reversion, conveyed onto the paper storage section 32 with the image-bearing surface of the paper P up.

By so doing, in an automatic document feeding apparatus 300 placed in the apparatus body 1, it is possible to make the order of feeding of a document G coincide with the order of discharging of copying paper P.

In the aforementioned preceding embodiment (FIG. 9), the same reference numerals are employed to designate parts or elements corresponding to those shown in the first-mentioned embodiment and any further explanation is, therefore, omitted for brevity's sake.

The present invention is not restricted to the aforementioned embodiments and various changes and modifications of the present invention can be made without departing from the spirit and scope of the present invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the kappended claims and their equivalents.

What is claimed is:

1. An image forming apparatus, comprising:

means for forming an image on a recording paper in an image forming position;

means for conveying the recording paper through the image forming position, the conveying means having a conveying path through which the recording paper is conveyed;

means, provided near the conveying means, for defining a predetermined spacing;

a unit for holding the conveying means as one body;

means for movably supporting the unit between a set position where the unit allows the conveying means to convey the recording paper and an opening position where the unit is moved in the spacing to open the conveying path; and means, provided on the spacing, for storing the recording paper conveyed by the conveying means.

2. The image forming apparatus according to claim 1, having an opening/closing unit including a pivotal member for pivotally supporting a rear side so as to enable a front side to provide a tilted-down end side in an open state.

3. The image forming apparatus according to claim 2, wherein the unit includes drive power transmitting means, arranged on the rear side, for transmitting a drive force to part of the conveying means.

4. The image forming apparatus according to claim 1, wherein the unit includes transferring means, arranged opposite to an image carrier, for transferring the image which is formed on the image carrier to the recording paper.

5. The image forming apparatus according to claim 2, wherein the opening/closing unit includes power supply means, arranged at the rear side, for supplying electric power to a transfer means.

6. The image forming apparatus according to claim 1, wherein the conveying means comprises a resist roller pair composed of an upper resist roller and lower resist roller between which a first paper conveying path extends, a belt conveyor provided on the lower side of the first paper conveying path, and a paper discharge roller pair composed of an upper paper discharge roller and lower paper discharge roller, and the unit has the lower resist roller in the resist roller pair, belt conveyor, lower paper discharge roller in the paper discharge roller pair and transferring means.

7. The image forming apparatus according to claim 3, wherein the supporting means includes actuating means for opening/closing the unit and a locking mechanism for locking a free end side of the unit.

8. The image forming apparatus according to claim 7, wherein the actuating means includes a hydraulic cylinder.

9. The image forming apparatus according to claim 1, wherein the spacing is formed below the image forming means.

10. An image forming apparatus, comprising:

means for forming an image on a recording paper in an image forming position;

means for conveying the recording paper through the image forming position, the conveying means having a first paper conveying path through which the recording paper is conveyed;

means, provided near the conveying means, for defining a predetermined spacing;

a unit for holding the conveying means as one body;

means for movably supporting the unit between a set position where the unit allows the conveying means to convey the recording paper and an opening position where the unit is moved in the spacing to open the conveying path;

means, provided on the spacing, for storing the recording paper conveyed by the conveying means; and an apparatus body for holding these means and members and having an access opening on a front side for exposing the paper storage means to an outside.

11. The image forming apparatus according to claim 10, wherein the unit has a pivotal member for pivotally supporting a rear side so as to enable the front side to provide a tilted-down side in an open state.

12. The image forming apparatus according to claim 11, wherein the unit has drive force transmitting means on the rear side for transmitting a drive force to part of the conveying means.

13. The image forming apparatus according to claim 11, wherein the unit has power supply means at the rear side for supplying electric power to a transferring means.

14. The image forming apparatus according to claim 10, wherein the conveying means includes a resist roller pair composed of an upper resist roller and lower resist roller past which the first paper conveying path extends, a belt conveyor provided on the lower side of the first paper conveying path, and a paper discharge roller pair composed of an upper resist roller and lower resist roller between which the first paper conveying path extends.

15. The image forming apparatus according to claim 10, wherein the conveying means comprises a resist roller pair composed of an upper resist roller and lower resist roller between which the first paper conveying path extends, a belt conveyor provided on the lower side of the first paper conveying path, and a paper discharge roller pair composed of an upper paper discharge roller and lower side paper discharge roller between which the first paper conveying path extends, and the unit has the lower resist roller in the resist roller pair, belt conveyor, lower paper discharge roller in the paper discharge roller pair and transferring means.

16. The image forming apparatus according to claim 10, wherein the supporting means includes actuating means for opening/closing the unit and a locking unit for locking a free end side of the unit.

17. The image forming apparatus according to claim 16, wherein the actuating means is composed of a hydraulic cylinder.

18. The image forming apparatus according to claim 10, wherein a terminal area of the first paper conveying path faces a paper discharge section provided on a side of the body and switching means is provided, between the terminal area of the first paper conveying path and a starting area of a second paper conveying path connected to the first paper conveying path, for switching the direction in which the paper is conveyed.

19. An image forming apparatus, comprising:

means for forming an image on a recording paper in an image forming position;

means for conveying the recording paper through the image forming position, the conveying means having a conveying path through which the recording paper is conveyed;

means, provided near the conveying means, for defining a predetermined spacing;

a unit for holding at least part of the conveying means as one body;

means for movably supporting the unit between a set position where the unit allows the conveying means to convey the recording paper and an opening position where the unit is moved in the spacing defined by the defining means to open the conveying path;

means, provided on the spacing, for storing the recording paper conveyed by the conveying means and being such that, in the conveying of the recording paper to the storing means, the recording paper is allowed to be stored with its image surface up;

a body for holding the forming means, conveying means, the defining means, the unit and the supporting means; and a handle provided at the unit so that the unit is moved between the set position and the opening position, the handle being arranged in a position which allows it to be operated on the outside of the body.

* * * * *